United States Patent [19]

Teter

[11] 4,214,401

[45] Jul. 29, 1980

[54] SIMULATED BURNER FOR A TOY COOKING RANGE

[75] Inventor: Edward C. Teter, East Aurora, N.Y.

[73] Assignee: The Quaker Oats Company, Chicago, Ill.

[21] Appl. No.: 963,501

[22] Filed: Nov. 24, 1978

[51] Int. Cl.[2] ..... A63H 3/52

[52] U.S. Cl. ..... 46/14

[58] Field of Search ..... 46/14; 272/8 R

[56] References Cited

U.S. PATENT DOCUMENTS

| | | | |
|---|---|---|---|
| 1,603,664 | 10/1926 | Coventry | 46/14 |
| 1,619,723 | 3/1927 | Hartman | 46/14 |
| 2,816,395 | 12/1957 | Page | 46/14 X |
| 3,205,610 | 9/1965 | Palumbo et al. | 46/14 |
| 3,774,338 | 11/1973 | Waak | 46/14 |

*Primary Examiner*—Louis G. Mancene
*Assistant Examiner*—Mickey Yu
*Attorney, Agent, or Firm*—Cumpston & Shaw

[57] ABSTRACT

A simulated burner for a toy cooking stove, range or the like. The burner comprises a first member having at least one slot extending therethrough. The burner has a second member having a projection complementary to and in register with the slot. The first and second members are preferably of contrasting colors. The first and second members are movable relative to one another causing the projection to gradually move between retracted and extended positions. In the retracted position, the projection is out of and adjacent one side of the slot and not appreciably visible to the operator. In this retracted position, the burner simulates an "off" or "no heat" condition. In the extended position, the projection extends through the slot and is highly visible to the operator. In this extended position, the burner simulates a maximum heat condition. In the positions between retracted and extended positions, the burner simulates varying heat conditions.

10 Claims, 4 Drawing Figures

SIMULATED BURNER FOR A TOY COOKING RANGE

BACKGROUND OF THE INVENTION

1. Field of the Invention

This invention relates generally to toy cooking stoves or ranges, and more specifically to a simulated burner for a toy cooking stove, range or the like.

2. Description of the Prior Art

Gas burners and electrical heating elements for stoves and ranges are, of course, well known in the art. In the design and manufacture of toy stoves and cooking ranges, it is a challenge to build such toys with burners that closely simulate the genuine or real thing and hence arouse the interest of children. In the past, many of the toys have had burners which are painted or rigidly affixed onto the range, and hence are devoid of any moving parts. Such burners are highly unimaginative, and children may soon lose interest in playing with toy stoves or ranges so equipped.

SUMMARY OF THE INVENTION

In accordance with the invention, a toy burner is provided to simulate a genuine burner of the type used in stoves or ranges for heating food or the like. The burner comprises a first preferably dark member having at least one slot extending therethrough. The burner further has a second member having a projection of a color preferably in contrast to the color of the first member. The projection is complementary to and in register with the slot and simulates a red hot flame or electric heating element. Means are provided for moving the first and second members relative to one another for moving the projection between a retracted position, in which the projection is out of and adjacent one side of the slot, and an extended position, in which the projection extends through the slot. In the retracted position, the burner simulates an "off" or "no heat" condition whereas in its extended position, it simulates a maximum heat condition. When the projection is gradually moved from its retracted position to its extended position, the simulated heat condition of the burner gradually increases to a maximum heat condition. When the projection is gradually moved from its extended position to its retracted position, the simulated heat condition of the burner gradually decreases to an "off" or "no heat" condition.

In another aspect of the invention, the projection is colored a bright or brilliant color, such as a blaze orange, and the first and second members are simultaneously rotatable together and axially movable relative to one another. The means for axially moving the first and second members relative to one another comprises cam means for axially moving the second member relative to the first member.

In a further aspect of the invention, the first and second members are rotatable about the same axis. The cam means for axially moving the first and second members comprises a fixed cam, and a cam follower on one of the first and second members which is rideable on the fixed cam.

In still another aspect of the invention, the moving means further comprises a manually movable lever coupled to one of the first and second members for rotating the two in unison.

In a specific aspect of the invention, the first member is a fixed circular grate member having a plurality of arcuate segmental slots extending therethrough. The second member is a circular plate member coaxial with the grate member. The second member has a plurality of brilliantly colored arcuate segmental upstanding projections complementary to and in register with the slots. The projections simulate a red-hot flame or electrical element. The grate and plate members are mounted for relative axial movement by any suitable mounting means. Moving means including cam means is provided for axially moving the plate relative to the grate for moving the projections varying distances into and out of the slots between extended and retracted positions respectively. In the extended position, the burner simulates a maximum heat condition whereas in the retracted position, the burner simulates an "off" or "no heat" condition.

In a more specific aspect of this invention, the mounting means for axially guiding the grate and plate comprises a depending pin on the grate insertable through and slideable within an aligned opening in the plate. The cam means for axially moving the first and second members comprises a fixed cam, and a cam follower on the plate rideable on the fixed cam. The moving means for rotatably moving the grate and plate in unison comprises a lever having one end coupled to the depending pin, and a knob coupled to the opposite end. The rotatable movement of the grate and plate causes the cam follower to ride on the fixed cam for axially moving the plate member relative to the grate member. The grate and plate members are covered by a fixed and transparent circular cover plate. The cover plate is provided with a plurality of radially spaced, circular grooves for receiving the projections when they are moved to an extended position. The transparent circular grooves tend to accentuate the brilliant color of the projections in their extended position. The color is reflected onto the sides of the grooves giving the operator the visual appearance that the heated area is larger than it actually is.

The advantage of this invention is to provide a burner for a toy stove or range that more closely simulates a real or genuine burner. The burner has moving parts that coact to produce a simulated flame or heated electrical element which, when adjusted, appears to vary in heat output. The burner is capable of being readily adjusted by a child between an "off" or "no heat" condition and a maximum heat condition, and during such adjustment the burner actually appears to vary in the degree of heat generated. Because of the high degree of similarity between the operation of the inventive burner and a real burner, toy cooking stoves or ranges equipped with the toy burners should highly appeal to the imagination of children. This is effectively achieved without presenting any danger to the children since no heat, in fact, is generated; merely the appearance of increasing and decreasing heat.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

With reference to FIGS. 1–4, a toy burner 6 of this invention is embodied in a toy range 8 or the like, only a portion of which is shown. The toy range 8 has a range top 10 provided with one or more openings 12 for receiving the toy burners, only one of which is shown.

Figure 1:
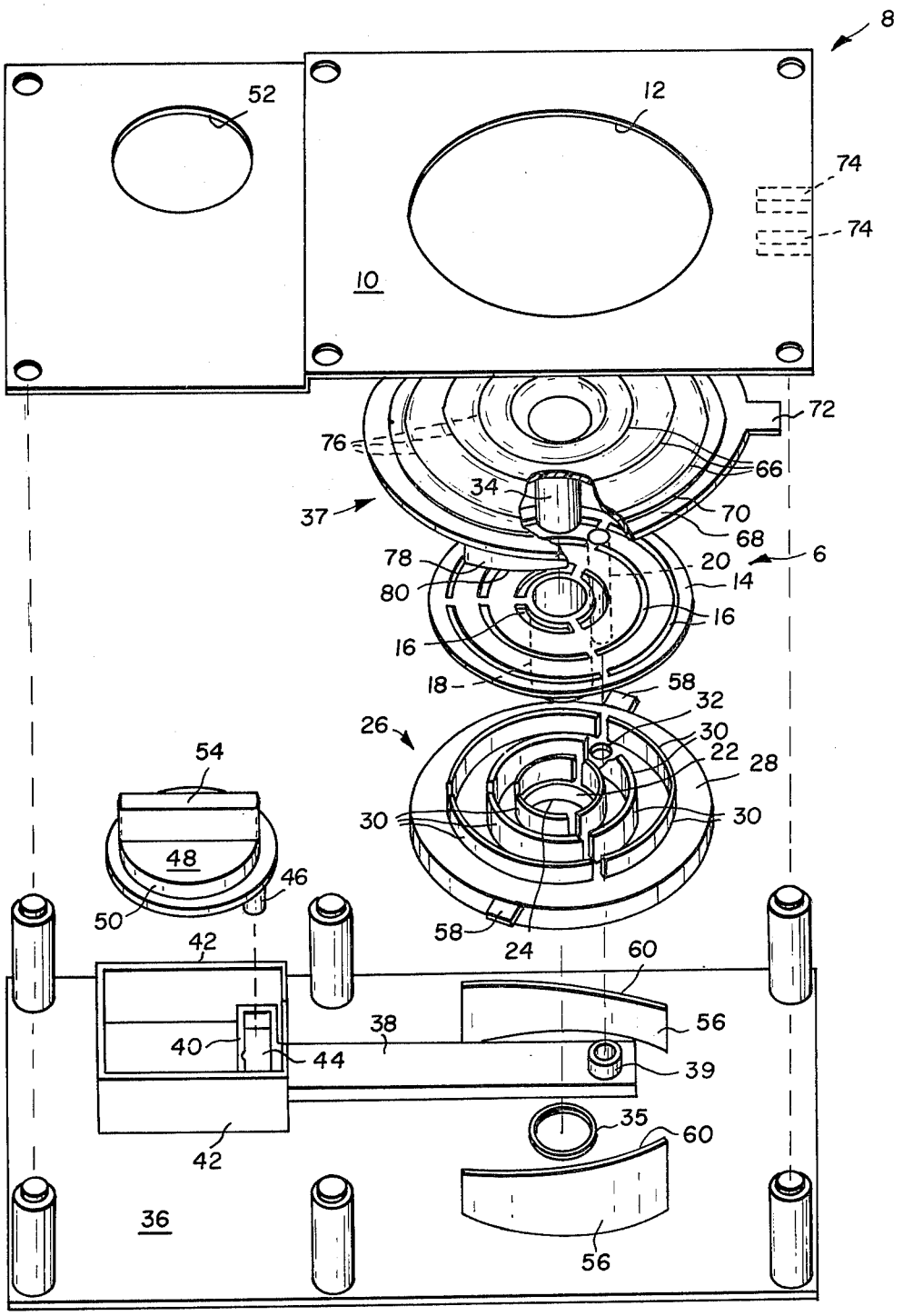
FIG. 1 is an exploded perspective view of the toy burner of this invention.

Each burner 6, as best seen in FIG. 1, comprises a preferably dark colored circular grate member 14 having a plurality of arcuate segmental radially spaced slots 16 extending therethrough. The grate member 14 further has an axially depending tubular shaft 18 and a radially spaced or eccentric depending pin 20. The shaft 18 extends through an opening 22 in a tube 24 axially depending from a circular plate member 26.

Although the grate 14 and plate 26 are circular and the slots define arcs of circles, it should be understood that the grate and plate could be square, rectangular or of any other suitable shape. Also, the slots could define straight line segments of a square, rectangle or any other suitable configuration.

The plate member 26 has a base 28 and a plurality of arcuate segmental upstanding projections 30. Projections 30 are complementary to and in register with slots 16 and capable of being moved into and out of the slots. All of the surfaces of the projections 30 are colored a contrasting color from the grate such as a brilliant orange or red to simulate a flame or red hot electrical heating element. The plate member 26 further has a hole 32 radially spaced from the axis of opening 22. Hole 32 is complementary to and in alignment with depending pin 20 of grate member 14 for slideably receiving the pin. Accordingly, by virtue of the pin 20 and hole 32 connection, grate 14 and plate 26 are axially movable relative to one another.

Figure 3:
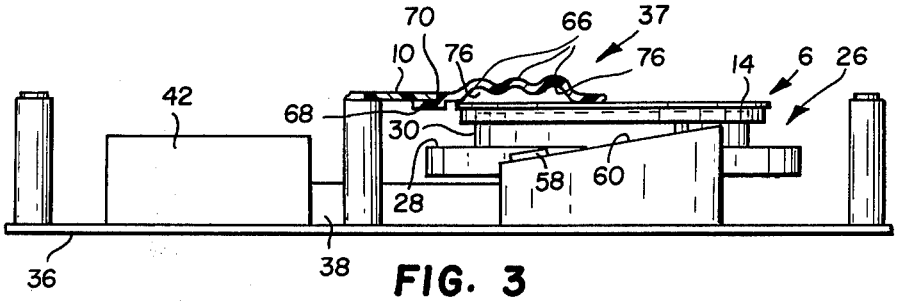
FIG. 3 is a side elevational view of the toy burner of FIG. 1 simulating an "off" or "no heat" condition, and with the cover plate broken away and the remainder of the cover and knob omitted.
Figure 4:
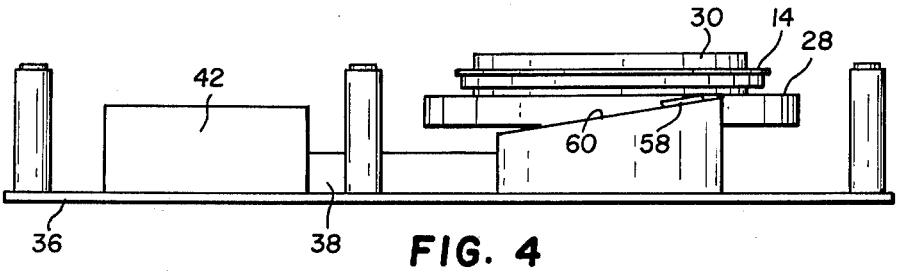
FIG. 4 is a view similar to FIG. 3 with the toy burner simulating a maximum heat condition, and with the upper plate, cover plate and knob omitted.

Axial movement of the grate and plate cause the projections 30 to move varying distances into slots 16 to simulate burners of varying heat output when viewed from above. The varying heat is achieved by the varying area of the brilliantly colored projections visible from above. More specifically, during "up" movement, the distance the projections 30 extend into slots 16 gradually increases thereby increasing the colored surface area of the projections visible to a stove user from above. Since the surface of projections 30 are preferably colored a brilliant orange or red in contrast to the dark colored grate 14, the increasing exposed colored surface simulates a burner in which the heat is gradually increasing. In the maximum "up" or "heat" position as seen in FIG. 4, the projections 30 extend through slots 16 so that the maximum colored surface is exposed. During "down" movement, the exposed colored projection surface gradually diminishes simulating a burner that is gradually decreasing in heat. In the maximum down position as seen in FIG. 3, the projections 30 are adjacent the bottom of the slots 16 so that only the narrow top surface of the projections are visible. In this "off" position, the burner 6 simulates an "off" or "no heat" condition. The grate 14 and plate 26 are also rotatable together in unison by virtue of the pin 20 and hole 32 connection. The tube 24 of plate member 26 is rotatable about stub shaft 18 which, in turn, is rotatable about a post 34 on a fixed circular cover plate 37 to be explained hereinafter. The end surface of post 34 extends into a ring 35 and into engagement with plate 36. The grate 14 is axially immovable with its upper surface in engagement with the lower surface of plate 37, and the end of shaft 18 engaging the upper surface of ring 35.

The means for rotating grate 14 and plate 26 in unison will now be described. The moving means comprises a lever 38 slideable on the upper surface of plate 36. Lever 38 has an annular ring 39 at one end into which the end portion of pin 20 extends for coupling lever 38 to grate 14 and plate 26. The opposite T-shaped end 40 of lever 38 is slideable between opposite guide walls 42. The end flange 40 has a transverse elongated slot 44 for receiving an eccentric pin 46 depending from a knob 48. The lower surface of knob 48 bears on the upper surface of guide walls 42. The upper end of knob 48 has a circular shoulder 50 that extends through a complementary circular opening 52 in range top 10. The outer rim of knob 48 is slideably interposed between the upper surface of guide walls 42 and the lower surface of range top 10. Knob 48 is rotatable within opening 52 by an upstanding handle 54. When the handle is manually grasped and knob 48 rotated in either direction between "off" and maximum heat or "on" positions, reciprocal movement is imparted to lever 38 via the pin 46 and slot 44 connection. The lever 38 in turn imparts rotation to grate 14 and plate 26 in unison via the pin 20, hole 32 and ring 39 connection. Any suitable detent means may be provided for knob 48 for simulating the "off" and maximum heat or "on" positions. Such detent means is illustrated in FIG. 1 as pin 46 which is adapted when slideably moved within slot 44 to nest within a central notch in lever end flange 40 in each of the "off" and "on" positions of knob 48.

Cam means are provided as best seen in FIGS. 1, 3 and 4 for imparting relative axial movement between the grate 14 and plate 26 while they are rotated in unison by the moving means. The axial movement is possible by virtue of the pin 20 and hole 32 connection which allows slideable movement of the pin relative to the hole. The cam means comprises a pair of opposed upstanding fixed cams 56 mounted on the lower range plate 36. Another coacting pair of diametrically opposed, radially extending cam followers 58 are provided on the periphery of plate member 26. During rotation of grate 14 and plate 26 in either direction, the cam followers 58 ride up or down inclined cam surfaces 60 of fixed cams 56. During such up or down movement of cam followers 58, the plate 26 is axially moved relative to axially immovable grate 14 causing the plate projections 30 to move varying distances into and out of grate slots 16. This, of course, varies the brilliantly colored area of projections 30 visible from above which, in turn, varies the simulated heat output of the burner.

Figure 2:
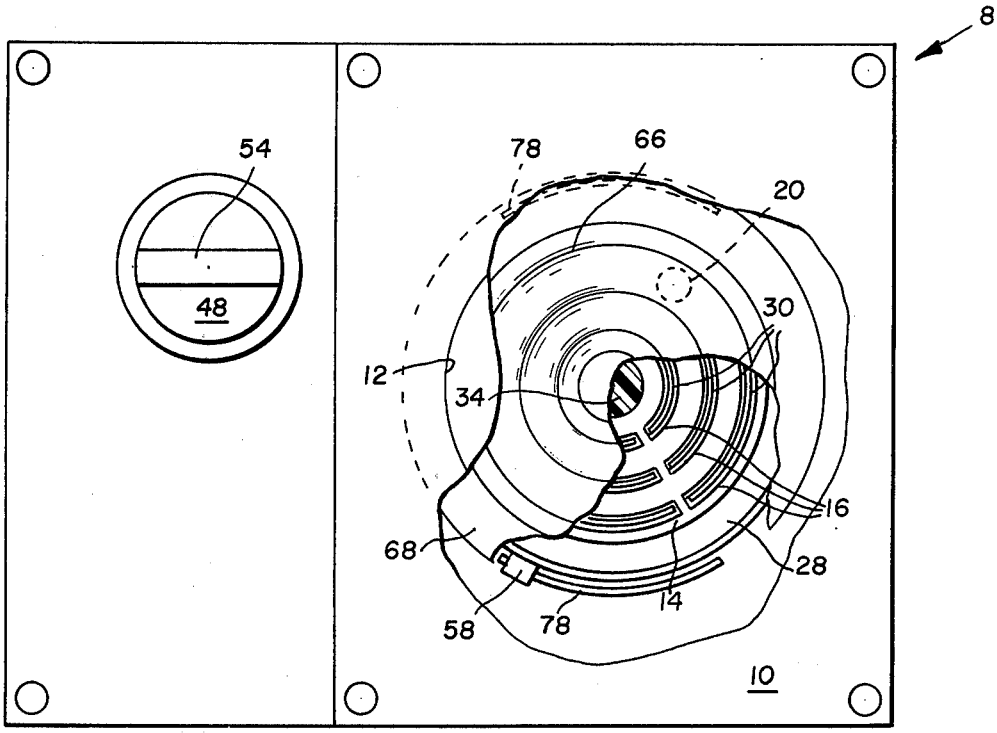
FIG. 2 is a top plan view of the toy burner of FIG. 1 with portions thereof broken away for purposes of clarity.

The grate 14 and plate 26 are protectively covered by the aforementioned cover plate 37 as best seen in FIGS. 1–3. Plate 37 has an upper center utensil receiving portion comprising radially spaced ridges 66, and a peripheral rim 68 joined thereto by a circular shoulder 70. The shoulder 70 nests within range top opening 12 with rim 68 bearing against the under surface of top 10. The cover plate 37 has a radially extending peripheral tab 72 that nests between spaced projections 74 depending from the undersurface of range top 10 for preventing rotatable movement of cover plate 37. The rim 68 of the cover plate is held in engagement with the undersurface of range top 10 by the upper surface of grate 14 bearing against the undersurface of cover plate 37. The lower center portion of plate 37 is provided with radially spaced circular grooves 76 (opposite ridges 66) for receiving the plate projections 30 during movement thereof to their maximum heat position.

The cam followers 58 are normally held in engagement with upwardly inclined cam surfaces 60 by the force of gravity acting on plate member 26. These cam surfaces 60 serve to positively cam the cam followers 58 and plate 26 upwardly. To assure down movement of cam follower 58 and plate 26, a pair of diametrically opposed fixed cams 78, only one of which is shown in FIG. 1, are provided depending from cover plate 37. The downwardly inclined cam surfaces 80 of cams 78 engage cam followers 58 and serve to positively cam the cam followers and plate 26 downwardly.

The invention has been described in detail with particular reference to a preferred embodiment, but it will be understood that variations and modifications can be effected within the spirit and scope of the invention.

What is claimed is:

1. A simulated burner for a toy cooking range comprising:

a first rotatable member having at least one slot extending therethrough;

a second member adjacent one side of the first member and rotatable therewith, said second member having a projection simulating a heated element complementary to and in register with the one slot; and cam means for axially moving the second member relative to the first member for moving the projection varying distances from the one side through the slot in one direction and back to the one side in the opposite direction for varying the amount of the projection visible from the opposite side of the first member, the burner simulating a "no heat" condition when the projection is adjacent the one side of the slot, and simulating gradually increasing and decreasing heat conditions as the projection is gradually moved in the one direction and opposite direction respectively.

2. The toy burner of claim 1 wherein the projection is colored a brilliant orange or the like to simulate a flame or heated electrical element.

3. The toy burner of claim 1 wherein the first and second members are rotatable about the same axis, and the cam means comprises a fixed cam, and a cam follower on one of the first and second members rideable on the fixed cam.

4. The toy burner of claim 1 wherein the first and second members are rotatable about the same axis, and are mounted for axial movement relative to one another, and the moving means comprises (1) a manually movable lever coupled to one of the first and second members for rotating the first and second members in unison, and (2) cam means for axially moving the first and second members relative to one another, said cam means comprising a fixed cam, and a cam follower on one of the first and second members rideable on the fixed cam.

5. A simulated burner for a toy cooking range comprising:

a circular rotatable grate member having a plurality of arcuate, segmental slots extending therethrough;

a circular plate member coaxial with the grate member and rotatable therewith, the plate member having a plurality of arcuate, segmental colored projections simulating a heated element complementary to and in register with the slots;

means for mounting the grate and plate members for relative axial movement; and means including cam means for axially moving the plate member relative to the grate member for moving the projections varying distances into and out of the slots for varying the colored portion of the projection visible from above whereupon the burner simulates a "no heat" condition when the projections are adjacent one side of the slots, and simulates gradually increasing and decreasing heat as the projections are gradually moved varying distances into and out of the slots respectively.

6. The toy burner according to claim 5 wherein the mounting means comprises an eccentric pin depending from the grate member and insertable through an opening in the plate member, the cam means comprises a fixed cam and a cam follower on the plate member rideable on the fixed cam, and the moving means comprises a lever having a knob coupled to one end of the lever for manually moving the lever, and the opposite end of the lever is coupled to the depending pin for rotating the grate and plate members in unison causing the cam follower to ride on the fixed cam for axially moving the plate member relative to the grate member.

7. The toy burner according to claim 5, and further comprising means for covering the grate and plate members.

8. The toy burner according to claim 7 wherein the covering means is a fixed circular cover plate which is substantially transparent.

9. The toy burner according to claim 8 wherein the cover plate has a plurality of radially spaced, circular grooves for receiving the projections when the projections are moved through the slots.

10. A simulated burner for a toy cooking range comprising:

a first rotatable member having at least one slot extending therethrough;

a second member coaxial with and adjacent to one side of the first member and rotatable therewith, said second member having a projection simulating a heated element complementary to and in register with the one slot;

means for rotating the first and second members; and cam means for axially moving the first and second members relative to one another during rotation thereof for moving the projection varying distances from the one side through the slot in one direction and back to the one side in the opposite direction for varying the amount of the projection visible from the opposite side of the first member, the burner simulating a "no heat" condition when the projection is adjacent the one side of the slot, and simulating gradually increasing and decreasing heat conditions as the projection is gradually moved in the one direction and opposite direction respectively.

* * * * *